US005447171A

United States Patent [19]

Shibano

[11] Patent Number: 5,447,171

[45] Date of Patent: Sep. 5, 1995

[54] PRESSURIZED ULTRASONIC CLEANING APPARATUS

[76] Inventor: Yoshihide Shibano, 1629-1-12, Oyama-cho, Machida-shi, Tokyo, Japan

[21] Appl. No.: 155,293

[22] Filed: Nov. 22, 1993

[30] Foreign Application Priority Data

Nov. 20, 1992 [JP] Japan ..... 4-311617

[51] Int. Cl.[6] ..... B08B 3/12

[52] U.S. Cl. ..... 134/102.2; 134/111; 134/184; 134/200; 134/188

[58] Field of Search ..... 134/184, 102.2, 200, 134/187, 188, 111

[56] References Cited

U.S. PATENT DOCUMENTS

| | | | |
|---|---|---|---|
| 4,193,818 | 3/1980 | Young et al. | 134/184 |
| 4,763,677 | 8/1988 | Miller | 134/184 |
| 5,377,709 | 1/1995 | Shibano | 134/184 |

FOREIGN PATENT DOCUMENTS

| | | | |
|---|---|---|---|
| 1311866 | 11/1962 | France | 134/1 |
| 1211926 | 8/1989 | Japan . | |
| 2-075385 | 6/1990 | Japan . | |
| 4-46637 | 7/1992 | Japan . | |
| 366498 | 2/1963 | Switzerland | 134/1 |
| 387756 | 8/1971 | U.S.S.R. | 134/184 |
| 584912 | 12/1977 | U.S.S.R. . | |
| 626842 | 9/1978 | U.S.S.R. . | |
| 776669 | 11/1980 | U.S.S.R. . | |

*Primary Examiner*—Frankie L. Stinson
*Attorney, Agent, or Firm*—Paul A. Guss

[57] ABSTRACT

An ultrasonic cleaning tank has a tank body for accommodating a cleaning solution, an ultrasonic vibrator housed in a sealing container mounted on a bottom wall of the tank body, and an openable lid for sealingly closing the tank body when a workpiece to be cleaned is immersed in the cleaning solution in the tank body. The cleaning solution is supplied to fill up an entire space in the ultrasonic cleaning tank when the tank body is closed by the lid. A pressurizing system for pressuring the cleaning solution which fills the ultrasonic cleaning tank includes a cleaning solution sealing tank for accommodating the cleaning solution independently of the ultrasonic cleaning tank, a liquid conduit interconnecting the ultrasonic cleaning tank and the cleaning solution sealing tank, and a pressurizing device for pressurizing the cleaning solution in the cleaning solution sealing tank to transmit the pressure applied to the cleaning solution through the liquid conduit to the ultrasonic cleaning tank.

4 Claims, 4 Drawing Sheets

PRESSURIZED ULTRASONIC CLEANING APPARATUS

BACKGROUND OF THE INVENTION

Field of the Invention

The present invention relates to an ultrasonic cleaning apparatus for cleaning workpieces to remove burrs, foreign matter, or the like from their surfaces by immersing the workpieces in a cleaning solution in an ultrasonic cleaning tank and radiating ultrasonic energy into the cleaning solution, and more particularly to a pressurized ultrasonic cleaning apparatus for ultrasonically cleaning workpieces immersed in a cleaning solution in an ultrasonic cleaning tank while the cleaning solution is being pressurized.

Description of the Prior Art

Heretofore, there have been known ultrasonic cleaning apparatus for cleaning workpieces to remove burrs, foreign matter, or the like from their surfaces by supplying a cleaning solution to an ultrasonic cleaning tank with an ultrasonic vibrator mounted therein, immersing the workpieces in the cleaning solution, and radiating ultrasonic energy into the cleaning solution.

When the ultrasonic energy is radiated from the ultrasonic vibrator into the cleaning solution, the cleaning solution is cavitated, and the workpiece is exposed to shock waves or microjets that are produced when the cavitation is collapsed. Foreign matter or burrs can be removed from the workpiece by those shock waves or microjets. For efficiently cleaning workpieces, it is necessary to provide conditions which facilitate the generation of the cavitation in the cleaning solution.

As a result of an analysis of those conditions, the inventor has found out that the cleaning solution can be cavitated more easily if the concentration of a gas dissolved in the cleaning solution is lower, and that if the concentration of a gas dissolved in the cleaning solution is too high, then the dissolved gas is converted into bubbles by the ultrasonic energy radiated by the ultrasonic vibrators, making the cavitation less susceptible to collapsing. Furthermore, since the ultrasonic energy is absorbed by the bubbles, the microjets are weakened by the bubbles. Therefore, when such bubbles are produced in the cleaning solution by the dissolved gas, the cleaning of the workpiece is essentially carried out only by the bubbles, but not by the ultrasonic energy.

The inventor has also found out that the cleaning solution can more easily be cavitated when the cleaning solution is deaerated and subjected to a suitable static pressure, and has proposed an ultrasonic cleaning apparatus which applies a static pressure to a deaerated cleaning solution while a workpiece immersed in the deaerated cleaning solution is being ultrasonically cleaned (see Japanese patent publication No. 4-46637).

As shown in FIG. 4 of the accompanying drawings, the proposed ultrasonic cleaning apparatus includes an ultrasonic cleaning tank 61 having a tank body 64 supplied with a cleaning solution 63, an ultrasonic vibrator 62 mounted on the bottom wall of the tank body 64, and a lid 66 which sealingly closes the tank body 64 when a workpiece 65 is immersed in the cleaning solution 63 in the tank body 64. The lid 66 is vertically movable by a cylinder 67 to open or close the tank body 64. An air conduit 69 having an air bleeder valve 68 is connected at a lower end thereof to an upper end of the lid 66.

The tank body 64 has a cleaning solution inlet 70 disposed on a side wall thereof. When the ultrasonic cleaning tank 61 is completed by the tank body 64 and the lid 66 that sealingly closes the tank body 64, the cleaning solution 63 is supplied from the cleaning solution inlet 70 to fill up the interior space of the ultrasonic cleaning tank 61. The cleaning solution inlet 70 is connected by a cleaning solution conduit 71 to a cleaning solution outlet 72 disposed on the side wall of the tank body 64 in diametrically opposite relation to the cleaning solution inlet 70. Specifically, the cleaning solution conduit 71 is connected to the cleaning solution outlet 72 through a flow control valve **73*a* and the cleaning solution inlet 70 through a flow control valve 73*b*. The cleaning solution conduit 71 is connected to the flow control valve 73*a* through a deaerating device 74 for deaerating the cleaning solution 63, a pump 75 for drawing the cleaning solution 63 from the cleaning solution outlet 72 and supplying the cleaning solution 63 to the deaerating device 74, and a filter 76 disposed upstream of the deaerating device 74 for removing foreign matter contained in the cleaning solution 63**.

A pressurizing cylinder 78 with a piston 77 is mounted on the side wall of the tank body 64. The pressurizing cylinder 78 serves as a pressurizing means for applying a static pressure to the cleaning solution 63 in the ultrasonic cleaning tank 61.

In operation, the closed ultrasonic cleaning tank 61 is filled up with the cleaning solution 63 that has been deaerated by the deaerating device 74, and the cleaning solution 63 in the ultrasonic cleaning tank 61 is pressurized under the static pressure applied by the piston 77 in the pressuring cylinder 78. Therefore, the proposed ultrasonic cleaning apparatus can easily achieve the conditions for facilitating the generation of the cavitation in the cleaning solution 63 to clean the workpiece 65 effectively.

The pressuring cylinder 78 is subject to large forces applied to pressurize the cleaning solution 63, and is directly coupled to the ultrasonic cleaning tank 61 through a relatively large opening. While the workpiece 65 is being ultrasonically cleaned, therefore, the pressuring cylinder 78 is exposed to intensive shock waves or microjets produced upon collapse of the cavitation developed in the cleaning solution 63. Particularly, the junction between the pressurizing cylinder 78 and the side wall of the tank body 64 tends to be broken by those shock waves or microjets. Since a portion of the ultrasonic cleaning tank 61 itself is used as a pressure cylinder, once the tank body 64 is broken, it is highly difficult to repair or restore the tank body 64. Usually, the broken tank body 64 and the pressurizing cylinder 78 coupled thereto must be replaced with a new combination.

SUMMARY OF THE INVENTION

It is therefore an object of the present invention to provide a pressurized ultrasonic cleaning apparatus having a pressuring means, which is less liable to be broken by shock waves or microjets, for pressurizing a cleaning solution in an ultrasonic cleaning tank.

According to the present invention, there is provided a pressurized ultrasonic cleaning apparatus comprising an ultrasonic cleaning tank having a tank body for accommodating a cleaning solution, with an ultrasonic vibrator housed in a sealing container mounted on a bottom wall of the tank body, and an openable lid for sealingly closing the tank body when a workpiece to be cleaned is immersed in the cleaning solution in the tank body, cleaning solution supply means for supplying the cleaning solution to fill up an entire space in the ultrasonic cleaning tank when the tank body is closed by the lid, and pressurizing means for pressuring the cleaning solution which fills the ultrasonic cleaning tank, the pressuring means comprising a cleaning solution sealing tank for accommodating the cleaning solution independently of the ultrasonic cleaning tank, a liquid conduit interconnecting the ultrasonic cleaning tank and the cleaning solution sealing tank, and a pressurizing device for pressurizing the cleaning solution in the cleaning solution sealing tank to transmit the pressure applied to the cleaning solution through the liquid conduit to the ultrasonic cleaning tank.

When the cleaning solution in the cleaning solution sealing tank is pressurized by the pressurizing device, since the cleaning solution in the cleaning solution sealing tank communicates with the cleaning solution in the ultrasonic cleaning tank, the pressure applied to the cleaning solution by the pressurizing device is transmitted through the liquid conduit to the cleaning solution in the ultrasonic cleaning tank. The pressurizing device is separate from and connected to the ultrasonic cleaning tank by the liquid conduit. Since the liquid conduit is much smaller in diameter than the conventional pressurizing cylinder, shock waves or microjets produced when the cavitation of the cleaning solution collapses are less liable to enter the liquid conduit. Therefore, the pressurizing device is protected from damage due to exposure to shock waves or microjets. The cleaning solution in the liquid conduit between the pressurizing device and the ultrasonic cleaning tank serves to dampen the shock waves or microjets. As a result, the pressurizing device is prevented from being broken by the shock waves or microjets.

The pressuring device may be an air pressurizing device such as an air compressor for pressurizing the cleaning solution in the cleaning solution sealing tank through a gas under pressure. The air pressurizing device can easily pressurize the cleaning solution in the cleaning solution sealing tank by introducing the gas under pressure into the cleaning solution sealing tank.

The pressurized ultrasonic cleaning apparatus may further comprise a cleaning solution circulating means for circulating the cleaning solution accommodated in said ultrasonic cleaning tank, said pressurizing means comprising means for transmitting the pressure to said ultrasonic cleaning tank through said cleaning solution circulating means. With the cleaning solution circulating means, the cleaning solution in the ultrasonic cleaning tank can be pressurized while it is being circulated. The cleaning solution circulating means may be combined with cooling means for cooling the cleaning solution which has been heated by an ultrasonic cleaning process or filter means for filtering the cleaning solution to remove oil and foreign matter which have been removed from the workpiece into the cleaning solution.

When the cleaning solution is pressurized by the pressuring device, the ultrasonic vibrator in the ultrasonic cleaning tank is also subjected to the pressure. To counteract the pressure, when the gas pressurizing device pressurizes the cleaning solution in the cleaning solution sealing tank through the gas under pressure, it should preferably introduce the gas under pressure into the sealing container to pressurize the interior space thereof. Since the interior space of the sealing container and the cleaning solution in the ultrasonic cleaning tank are pressurized by the common air pressurizing device, the interior space of the sealing container is pressurized to the same pressure as the cleaning solution in the ultrasonic cleaning tank. The pressure developed in the sealing container now acts to oppose the pressure exerted from the cleaning solution in the ultrasonic cleaning tank, for thereby protecting the ultrasonic vibrator in the sealing container.

The interior space of the sealing container may be pressurized by introducing a liquid under pressure. When the ultrasonic vibrator is continuously energized, it is heated and its temperature rises. However, introduction of a liquid into the sealing container cools the ultrasonic vibrator to suppress its heating. The liquid should preferably comprise a refrigerant having a high heat-exchanging capability, and which does not erode the sealed container and the ultrasonic vibrator and also which does not cause a dielectric breakdown of the ultrasonic vibrator.

When the interior space of the sealing container is pressurized by introducing a liquid under pressure, the pressurized ultrasonic cleaning apparatus may further comprise a liquid sealing tank for accommodating a liquid to be introduced under pressure into the sealing container, and a liquid pressurizing conduit interconnecting the sealing container and the liquid sealing tank, and the pressurizing device may comprise a gas pressurizing device for pressurizing the cleaning solution in the cleaning solution sealing tank using a gas under pressure, and pressurizing the liquid in the liquid sealing tank through the gas under pressure to transmit the pressure applied to the liquid through the liquid pressurizing conduit to the sealing container.

Irrespective of whether the interior space of the sealing container is pressurized by a gas or a liquid, since the interior space of the sealing container and the cleaning solution in the ultrasonic cleaning tank are pressurized by the common air pressurizing device, it is not necessary to employ an independent pressurizing device for pressurizing the interior space of the sealing container. Therefore, the overall arrangement of the pressurizing ultrasonic cleaning apparatus may be relatively simple.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
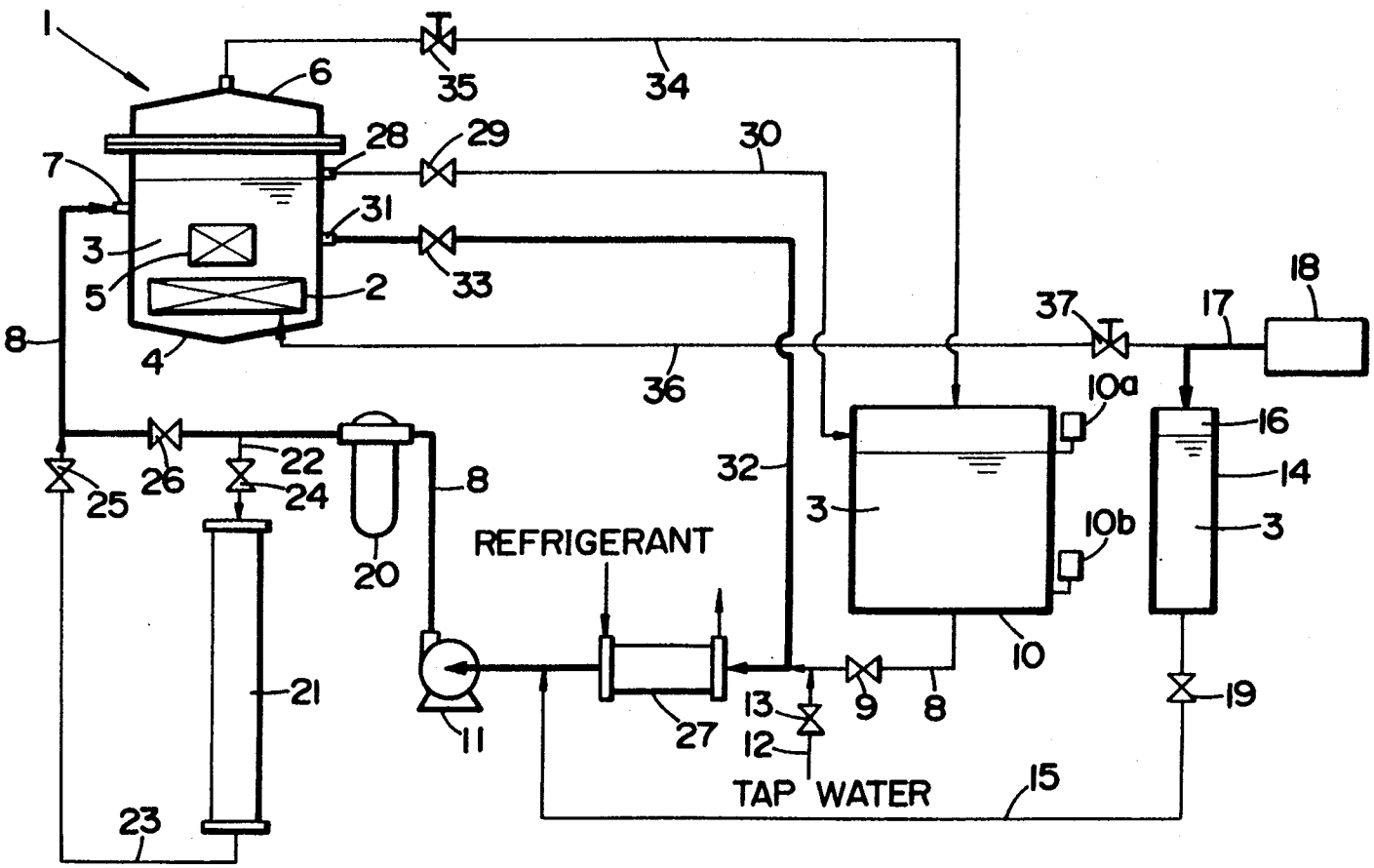
FIG. 1 is a diagram schematically showing a pressurized ultrasonic cleaning apparatus according to an embodiment of the present invention.

As shown in FIG. 1, a pressurized ultrasonic cleaning apparatus according to an embodiment of the present invention includes an ultrasonic cleaning tank 1 comprising a tank body 4 for holding a deaerated cleaning solution 3, the tank body 4 accommodating a sealed container 2 disposed on the bottom wall thereof and housing an ultrasonic vibrator therein, and an openable lid 6 which sealingly closes the tank body 4 when a workpiece 5 to be cleaned is immersed in the cleaning solution 3 in the tank body 4.

The tank body 4 has a cleaning solution inlet 7 disposed on a side wall thereof. When the ultrasonic cleaning tank 1 is completed by the tank body 4 and the lid 6 that sealingly closes the tank body 4, the cleaning solution 3 is supplied from the cleaning solution inlet 7 to fill up the interior space of the ultrasonic cleaning tank 1. The cleaning solution inlet 7 is connected by a cleaning solution supply conduit 8 to a cleaning solution reservoir tank 10 through a supply control valve 9. The cleaning solution supply conduit 8 is connected to a pump 11 which supplies the cleaning solution 3 from the cleaning solution reservoir tank 10 to the ultrasonic cleaning tank 1. A tap water conduit 12 is connected to the cleaning solution supply conduit 8 downstream of the supply control valve 9 through a tap water control valve 13.

The pressurized ultrasonic cleaning apparatus also includes a cleaning solution sealing tank 14 for holding the cleaning solution 3 independently of the ultrasonic cleaning tank 1. The cleaning solution sealing tank 14 is connected to the cleaning solution supply conduit 8 through a liquid conduit 15, and hence connected to the ultrasonic cleaning tank 1 through the cleaning solution supply conduit 8. The cleaning solution sealing tank 14 has an upper space 16 defined therein above the cleaning solution 3 stored therein, the upper space 16 communicating with an air compressor 18 through an air pressurizing conduit 17. The air compressor 18 supplies air under pressure into the upper space 16 in the cleaning solution sealing tank 14 for thereby pressurizing the cleaning solution 3. The liquid conduit 15 is connected to the cleaning solution sealing tank 14 through a tank pressure control valve 19.

A filter 20 for filtering out oil and foreign matter from the cleaning solution 3 and a deaerating device 21 for deaerating the cleaning solution 3 are connected to the cleaning solution supply conduit 8 downstream of the pump 11. To the cleaning solution supply conduit 8, there are connected a solution introduction conduit 22 for introducing the cleaning solution 3 from the cleaning solution supply conduit 8 into the deaerating device 21, and a solution supply conduit 23 for supplying the deaerated cleaning solution 3 from the deaerating device 21 to the cleaning solution supply conduit 8. The solution introduction conduit 22 and the solution supply conduit 23 are connected respectively through a solution introduction valve 24 and a solution supply valve 25 to the cleaning solution supply conduit 8. The cleaning solution supply conduit 8 has a flow control valve 26 between its junctions to the solution introduction conduit 22 and the solution supply conduit 23 for controlling the rate of the cleaning solution 3 flowing through the cleaning solution supply conduit 8 between those junctions thereby to control the rate of the cleaning solution 3 that is deaerated by the deaerating device 21.

The deaerating device 21 may comprise a device for introducing the cleaning solution 3 into a sealed reservoir tank that has been evacuated by a vacuum pump, to allow the air dissolved by the cleaning solution 3 to be discharged and hence removed into the evacuated space in the sealed reservoir tank. Alternatively, the deaerating device 21 may comprise a gas separating membrane module having a number of hollow fibrous gas separating membranes for passing the cleaning solution 3 therethrough and discharging and hence removing the gas dissolved in the cleaning solution 3 through the membrane walls into an outside space that has been evacuated.

A cooling device 27 for cooling the cleaning solution 3 is connected to the cleaning solution supply conduit 8 upstream of the pump 11. The cooling device 27 is disposed around the cleaning solution supply conduit 8, and passes therethrough a refrigerant cooled by a cooling unit (not shown) for thereby cooling the cleaning solution 3 that flows through the cleaning solution supply conduit 8.

The ultrasonic cleaning tank 1 has a cleaning solution discharge port 28 mounted on an upper portion of the side wall of the tank body 4 for discharging the cleaning solution from the ultrasonic cleaning tank 1 when the ultrasonic cleaning tank 1 is opened by the lid 6. The cleaning solution discharge port 28 is connected through a discharge control valve 29 to an end of a solution discharge conduit 30 which has its other end connected to the cleaning solution reservoir tank 10. The cleaning solution reservoir tank 10 has a flow sensor 10*a* for detecting an overflow of the cleaning solution 3 as it returns from the solution discharge conduit 30 and a flow sensor 10*b* for detecting a shortage of the cleaning solution 3 in the cleaning solution reservoir tank 10. These flow sensors 10*a*, 10*b* cooperate with each other to keep a suitable amount of cleaning solution 3 to be supplied to the ultrasonic cleaning tank 1.

The ultrasonic cleaning tank 1 has a cleaning solution outlet 31 disposed on the side wall of the tank body 4 in diametrically opposite relationship to the cleaning solution inlet 7. A cleaning solution withdrawal conduit 32 for with-drawing the cleaning solution 3 from the ultrasonic cleaning tank 1 is connected at one end thereof through a circulation control valve 33 to the cleaning solution outlet 31. The other end of the cleaning solution withdrawal conduit 32 is connected to the cleaning solution supply conduit 8. The cleaning solution withdrawal conduit 32 with the circulation control valve 33 serves as a circulating means for circulating the cleaning solution 3 through the cleaning solution supply conduit 8 and the cleaning solution inlet 7 to the ultrasonic cleaning tank 1.

An air bleeder conduit 34 is connected at an end thereof through an air bleeder valve 35 to the top of the lid 6 of the ultrasonic cleaning tank 1. The other end of the air bleeder conduit 34 is joined to the cleaning solution reservoir tank 10. When the tank body 4 is closed by the lid 6 and the ultrasonic cleaning tank 1 is supplied with the cleaning solution 3, the air bleeder valve 35 which comprises a three-way valve discharges the air that has been trapped in the upper space in the ultrasonic cleaning tank 1 and returns any excessively supplied cleaning solution 3 to the cleaning solution reservoir tank 10.

An air conduit 36 is branched from the air pressurizing conduit 17 through a vibrator pressurization control valve 37, and connected to the ultrasonic cleaning tank 1. At the same time the cleaning solution 3 in the ultrasonic cleaning tank 1 is pressurized, air is supplied from the air compressor 18 through the air conduit 36 into the sealed container 2 to maintain the air pressure therein at substantially the same level as the cleaning solution 3 in the ultrasonic cleaning tank 1. The vibrator pressurization control valve 37 comprises a three-way valve capable of removing air when the air compressor 18 is deactivated. Such an arrangement for use with the ultrasonic vibrator is disclosed in detail in Japanese utility model application No. 5-55364 filed by the inventor of the present invention.

The mechanical structure of the ultrasonic cleaning tank 1 will be described below with reference to FIG. 2. The piping is omitted from illustration in FIG. 2.

Figure 2:
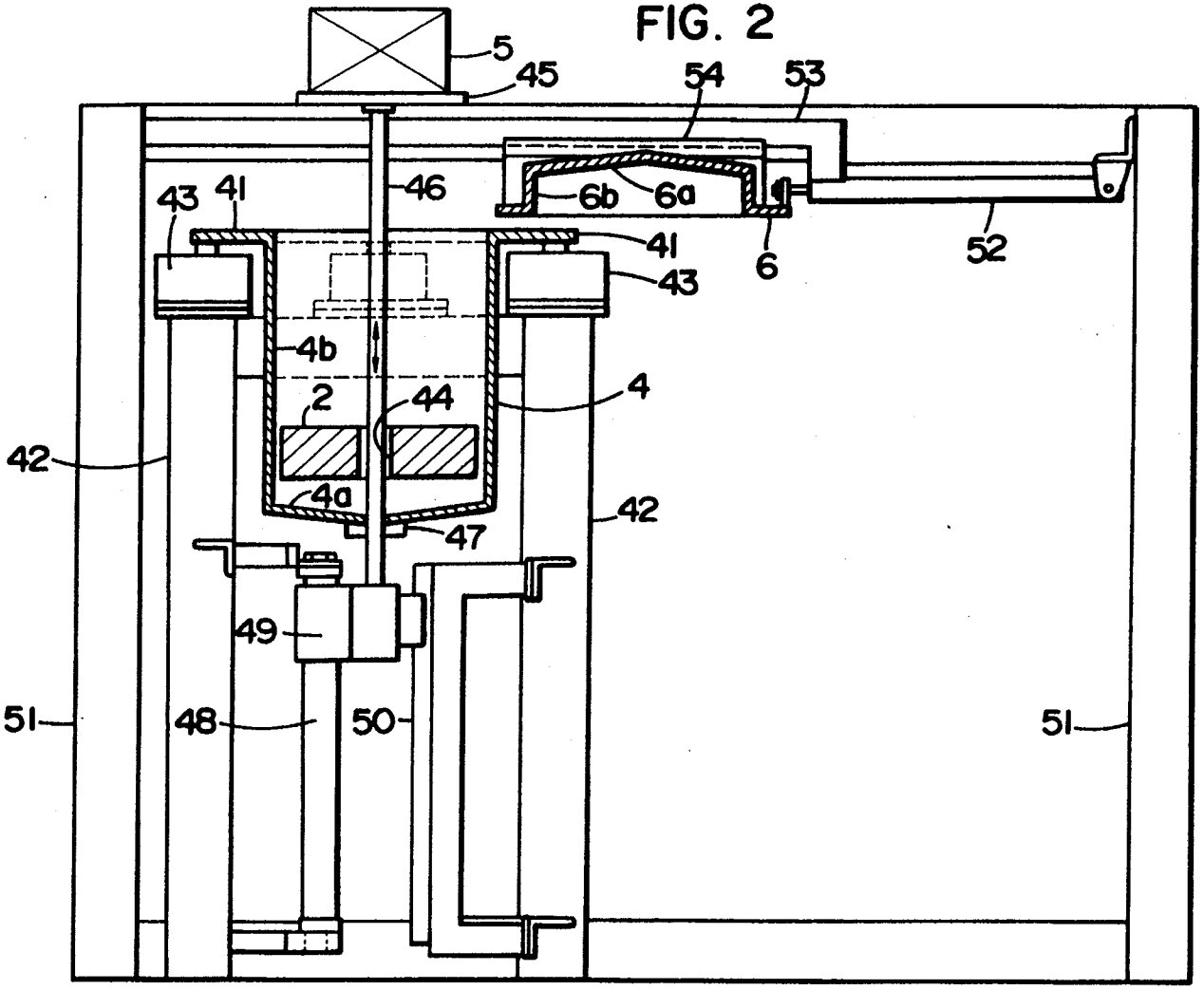
FIG. 2 is a side elevational view, partly in cross section, of an ultrasonic cleaning tank of the pressurized ultrasonic cleaning apparatus.

As shown in FIG. 2, the tank body 4 of the ultrasonic cleaning tank 1 has a flange 41 along an upper peripheral edge thereof. The flange 41 is supported on a plurality of low-profile cylinders 43 mounted on respective support columns 42 so that the flange 41 can be vertically moved by the cylinders 43. In this embodiment, there are four low-profile cylinders 43 that are angularly spaced at intervals of 90° along the flange 41.

The sealed container 2 which houses the ultrasonic vibrator has a vertical through hole 44 extending centrally therethrough, and a vertical rod 46 supporting on its upper end a table 45 for placing the workpiece 5 thereon extends vertically through the vertical through hole 44. The rod 46 extends vertically through the tank body 4 and also a bushing 47 which is hermetically attached to the outer surface of the bottom wall of the tank body 4. The rod 46 is vertically movably supported on a rodless cylinder 48 which is supported on one of the support columns 42. Specifically, the rod 46 is supported by a support leg 49 of the rodless cylinder 48 which is vertically slidable in engagement with a vertical rail 50 that is mounted on the other support column 42 which confronts the rodless cylinder 48.

The lid 6 of the ultrasonic cleaning tank 1 is horizontally movably supported by a horizontal air cylinder 52 which is attached to one of support columns 51. The lid 6 is horizontally movable along a rail 54 that extends horizontally and is attached to the support columns 51 through a support beam 53.

Operation of the pressurized ultrasonic cleaning apparatus will be described below.

Before the workpiece 5 is ultrasonically cleaned, the lid 6 is positioned as shown in FIG. 2, opening the tank body 4. Tap water as the cleaning solution 3 is supplied from the tap water conduit 12 to the tank body 4, the cleaning solution reservoir tank 10, and the cleaning solution sealing tank 14. After the tank body 4, the cleaning solution reservoir tank 10, and the cleaning solution sealing tank 14 have been supplied with respective amounts of cleaning solution 3, the tap water control valve 13 is closed. At this time, the supply control valve 9, the tank pressure control valve 19, the flow control valve 26, and the discharge control valve 29 are closed, and the circulation control valve 33, the solution introduction valve 24, and the solution supply valve 25 are closed.

The tank body 4 is supplied with the cleaning solution 3 up to the level of the cleaning solution discharge port 28. Then, the cleaning solution 3 in the tank body 4 is drawn from the cleaning solution withdrawal port 31 by the pump 11, cooled by the cooling device 27, filtered by the filter 20, and then deaerated by the deaerating device 21. Therefore, the tank body 4 is supplied with the cleaning solution 3 which has been cooled to a predetermined temperature and deaerated, from the cleaning solution inlet 7.

The workpiece 5 is then immersed in the cleaning solution 3 in the tank body 4. Specifically, the workpiece 5 which has been delivered from a manufacturing station by a delivery mechanism is placed on the table 45 above the tank body 4 as shown in FIG. 2. Then, the rodless cylinder 48 is actuated to lower the rod 46 which supports the table 45 until the workpiece 5 is lowered to a cleaning position above the sealed container 2 in the tank body 4.

Thereafter, the air cylinder 52 is actuated to move the lid 6 along the rail 54 to a position where the tank body 4 is to be closed by the lid 6. Then, the low-profile cylinders 43 are actuated to lift the tank body 4 until it is pressed against the lid 6. Since the lid 6 is supported on the rail 54 engaged by the support beam 53, the lid 6 is held in position against pressure exerted from the low-profile cylinders 43. Now, the tank body 4 is sealed by the lid 6.

When the ultrasonic cleaning tank 1 is thus completed, the air bleeder valve 35 is actuated to vent the air bleeder conduit 34 to the atmosphere, and the supply control valve 9 is opened to supply the cleaning solution 3 from the cleaning solution reservoir tank 10 to the ultrasonic cleaning tank 1. The air which has been trapped in the ultrasonic cleaning tank 1 above the level of the cleaning solution 3 supplied thereto is removed through the air bleeder conduit 4 and the air bleeder valve 35. Therefore, the entire interior space of the ultrasonic cleaning tank 1 is filled up with the cleaning solution 3. Since the cleaning solution 3 is supplied through the cooling device 27 and the deaerating device 21 to the ultrasonic cleaning tank 1, the cleaning solution 3 that fills up the ultrasonic cleaning tank 1 is cooled and deaerated.

Upon elapse of a certain period of time which is long enough for the ultrasonic cleaning tank 1 to be filled up with the cleaning solution 3, the supply control valve 9 is closed. At the same time, the air bleeder valve 35 is actuated to connect the air bleeder conduit 34 to the cleaning solution reservoir tank 10. Therefore, any cleaning solution 3 which is excessively supplied to the ultrasonic cleaning tank 1 returns from the ultrasonic cleaning tank 1 through the air bleeder conduit 34 to the cleaning solution reservoir tank 10. The air bleeder valve 35 is closed immediately after the excessive cleaning solution 3 returns to the cleaning solution reservoir tank 10. Thus, the space in the ultrasonic cleaning tank 1 above the level of the cleaning solution discharge port 28 is filled up with the cleaning solution 3, with no air remaining trapped therein.

At the same time the air bleeder valve 35 is closed, the solution introduction valve 24 and the solution supply valve 25 are closed, and the flow control valve 26 is opened. As a result, while the ultrasonic cleaning tank 1 is being filled up with the deaerated cleaning solution 3, the cleaning solution 3 drawn from the cleaning solution outlet 31 circulates through the cleaning solution withdrawal conduit 32 and the solution supply conduit 8 to the cleaning solution inlet 7. Since the cleaning solution 3 does not flow through the deaerating device 21, the cleaning solution 3 circulates in a closed system.

When the closed system is completed for the cleaning solution 3, the air compressor 18 is actuated and the tank pressure control valve 19 is opened to start pressurize the cleaning solution 3 in the ultrasonic cleaning tank 1. Simultaneously, the vibrator pressurization control valve 37 is opened to connect the air compressor 13 to the sealed container 2 through the air conduit 36, thereby starting to pressurize the sealed container 2.

When the air compressor 18 is actuated, air is introduced under pressure into the upper space 16 in the cleaning solution sealing tank 14, pressurizing the cleaning solution 3 therein. Inasmuch as the cleaning solution 3 in the cleaning solution sealing tank 14 communicates with the cleaning solution 3 in the ultrasonic cleaning tank 1 through the liquid conduit 15 and the cleaning solution supply conduit 8, the pressure applied by the air compressor 13 is transmitted through the cleaning solution 3 to the ultrasonic cleaning tank 1, thus pressurizing the cleaning solution 3 therein.

In the ultrasonic cleaning tank 1, the cleaning solution 3 is pressurized, and air is also supplied under pressure to the sealed container 2 through the air conduit 36 by the air compressor 18 so that the interior space of the sealing container 2 is pressurized up to the same level as the cleaning solution 3 in the ultrasonic cleaning tank 1. Since the interior space of the sealing container 2 and the cleaning solution 3 in the ultrasonic cleaning tank 1 are pressurized by the air compressor 18, the pressure in the sealing container 2 increases in proportion to the pressure of the cleaning solution 3 in the ultrasonic cleaning tank 1. Therefore, the pressurization of either the interior or exterior of the sealing container 2 is prevented.

Because the cleaning solution 3 in the cleaning solution sealing tank 14 is held in contact with the pressurized air from the air compressor 18, the air is dissolved in the cleaning solution 3, and hence the amount of dissolved air in the cleaning solution 3 increases. However, the cleaning solution 3 in the cleaning solution sealing tank 14 communicates with the cleaning solution 3 in the ultrasonic cleaning tank 1 through the liquid conduit 15 and the cleaning solution supply conduit 8 which extend over a certain distance, the air dissolved in the cleaning solution 3 in the cleaning solution sealing tank 14 does not immediately reach the ultrasonic cleaning tank 1. Consequently, the amount of air dissolved in the cleaning solution 3 in the ultrasonic cleaning tank 1 is prevented from being increased by the air dissolved in the cleaning solution 3 in the cleaning solution sealing tank 14.

Thereafter, the ultrasonic vibrator housed in the sealed container 2 is actuated to radiate ultrasonic energy into the cleaning solution 3 in the ultrasonic cleaning tank 1 to ultrasonically clean the workpiece 5 in the cleaning position. As described above, the cleaning solution 3 in the ultrasonic cleaning tank 1 has been cooled and deaerated, and is pressurized. Thus, the cleaning solution 3 is easily cavitated by the applied ultrasonic energy. Upon collapse of the cavitation, intensive shock waves or microjets are produced to efficiently and effectively remove burrs and foreign matter from the surface of the workpiece 5.

At this time, the cleaning solution sealing tank 14 communicates with the ultrasonic cleaning tank 1 through the liquid conduit 15 and the cleaning solution supply conduit 8, which are much smaller in diameter than the conventional pressurizing cylinder. Therefore, the shock waves or microjets produced upon collapse of the cavitation are not liable to enter the liquid conduit 15 and the cleaning solution supply conduit 8. Furthermore, the cleaning solution 3 in the liquid conduit 15 and the cleaning solution supply conduit 8 dampen any shock waves or microjets introduced therein. Consequently, the cleaning solution sealing tank 14 is prevented from being damaged by the shock waves or microjets.

As shown in FIG. 2, the tank body 4 has a bottom wall **4*a*, and the lid 6 has a ceiling wall 6*a*. The bottom wall 4*a* and the ceiling wall 6*a* are neither hemispherical nor convex in shape, but are of a linear cross section. The bottom wall 4*a* is joined to a side wall 4*b* of the tank body 4 through a sharp angular corner, rather than a smooth round corner. Similarly, the ceiling wall 6*a* is joined to a side wall 6*b* of the lid 6 through a sharp angular corner, rather than a smooth round corner. These configurations of the bottom wall 4*a* and the ceiling wall 6*a* allow the position where the cleaning solution 3** is cavitated to be controlled easily depending on the cleaning position.

Oil and foreign matter that are removed from the workpiece 5 by the above ultrasonic cleaning process are scattered in the cleaning solution 3 in the ultrasonic cleaning tank 1. Such scattered oil and foreign matter are filtered out by the filter 20 while the cleaning solution 3 is drawn from the cleaning solution withdrawal conduit 32, and circulates through the cleaning solution supply conduit 8 to the cleaning solution inlet 7. Accordingly, the cleaning solution 3 remains clean in the ultrasonic cleaning tank 1.

The temperature of the cleaning solution 3 in the ultrasonic cleaning tank 1 rises when the ultrasonic vibrator is heated during the ultrasonic cleaning process. However, inasmuch as the cleaning solution 3 is cooled by the cooling device 27 when it circulates as described above, the cleaning solution 3 in the ultrasonic cleaning tank 1 is maintained at a predetermined temperature at all times.

When the ultrasonic cleaning process is finished, the air compressor 18 is deactivated, and the vibrator pressurization control valve 37 is vented to the atmosphere. The air kept under pressure in the cleaning solution sealing tank 14 and the sealing container 2 is discharged from the vibrator pressurization control valve 37, so that the cleaning solution 3 in the ultrasonic cleaning tank 1 and the interior space of the sealed container 2 are released from the pressurized condition.

Then, the tank pressure control valve 19 is closed, the air bleeder valve 35 is opened so as to vent the air bleeder conduit 34 to the atmosphere, and the discharge control valve 29 is opened. Since the ultrasonic cleaning tank 1 is vented to the atmosphere when the air bleeder valve 35 is opened, the cleaning solution 3 above the level of the cleaning solution discharge port 28 in the ultrasonic cleaning tank 1 is discharged from the cleaning solution discharge port 28 under the atmospheric pressure, and flows through the solution discharge conduit 30 back to the cleaning solution reservoir tank 10.

When the cleaning solution 3 in the ultrasonic cleaning tank 1 is reduced to the level of the cleaning solution discharge port 28, the discharge control valve 29 is closed. At the same time, the flow control valve 26 is closed, the solution introduction valve 24 and the solution supply valve 25 are opened. The parts of the pressurizing ultrasonic cleaning apparatus are now in their initial state.

In FIG. 2, the tank body 4 is lowered, the lid 6 is retracted to open the tank body 4, and the rod 46 is elevated. The cleaned workpiece 5 is discharged from the pressurizing ultrasonic cleaning apparatus. One cycle of cleaning operation is now completed.

After the cleaning process, the amount of air dissolved in the cleaning solution 3 in the ultrasonic cleaning tank 1 is increased. However, since the parts of the pressurizing ultrasonic cleaning apparatus are back in their initial state, while the cleaning solution 3 in the tank body 4 is circulating from the cleaning solution withdrawal conduit 32 through the cleaning solution supply conduit 8 to the cleaning solution inlet 7, the cleaning solution 3 is deaerated by the deaerating device 21. Therefore, the cleaning solution 3 in the ultrasonic cleaning tank 1 is deaerated before a next cycle of cleaning solution is started.

As the above cleaning process is repeated, the amount of cleaning solution 3 which returns from the ultrasonic cleaning tank 1 to the cleaning solution reservoir tank 10 progressively decreases as a certain amount of cleaning solution 3 is removed with the cleaned workpiece 5 in each cleaning cycle. When a shortage of cleaning solution in the cleaning solution reservoir tank 10 is detected by the flow sensor **10*b*, tap water is continuously supplied from the tap water conduit 12 to the cleaning solution reservoir tank 10 until it is detected by the flow sensor 10*a***.

Figure 3:
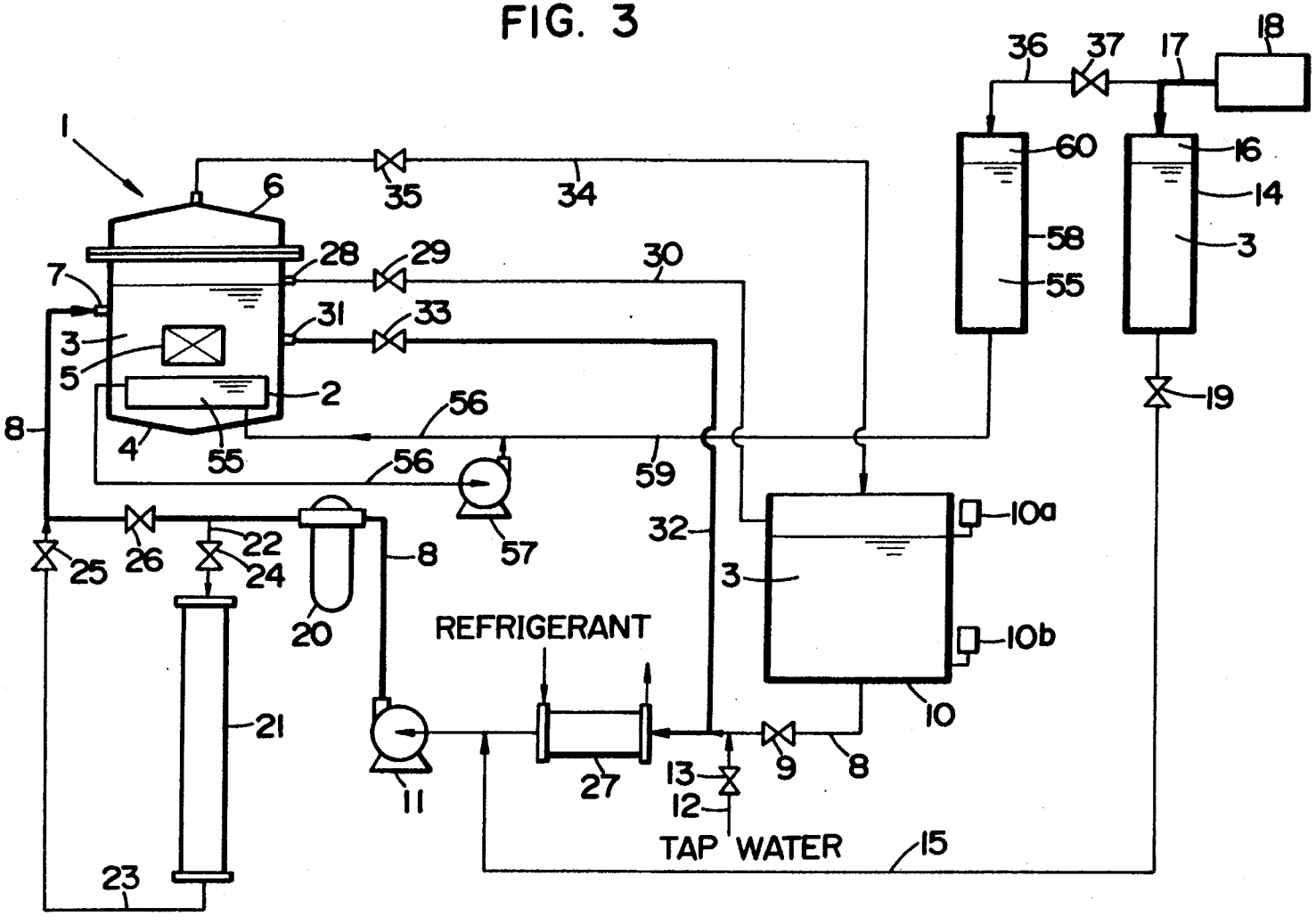
FIG. 3 is a diagram schematically showing a pressurized ultrasonic cleaning apparatus according to another embodiment of the present invention.
Figure 4:
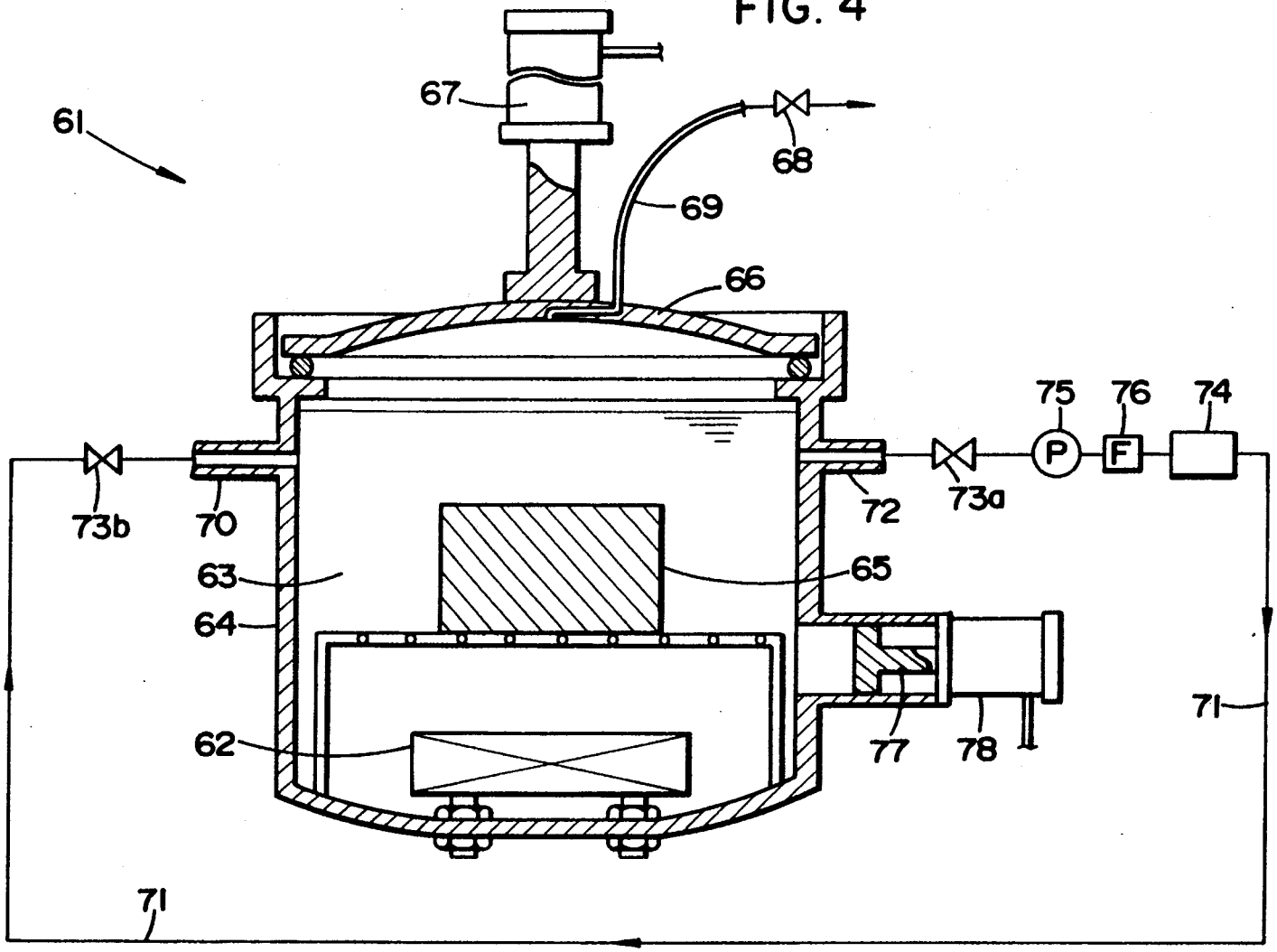
FIG. 4 is a cross-sectional view of a conventional pressurized ultrasonic cleaning apparatus.

In the above embodiment, air is introduced under pressure into the sealed container 2. However, since the ultrasonic vibrator in the sealed container 2 is heated to a higher temperature when continuously actuated, cooled air or a liquid may be supplied to the sealed container 2 for cooling the ultrasonic vibrator therein. FIG. 3 shows a pressurized ultrasonic cleaning apparatus according to another embodiment of the present invention in which a liquid is used to cool the ultrasonic vibrator. Those parts shown in FIG. 3 which are identical to those shown in FIG. 1 are denoted by identical reference numerals and characters. As shown in FIG. 3, a cooling liquid 55 is accommodated in the sealed container 2, and a cooling liquid circulation conduit 56 is connected to the sealed container 2 for circulating the cooling liquid 55 therethrough, with a pump 57 connected to the cooling liquid circulation conduit 56. A cooling liquid sealing tank 58 which accommodates the cooling liquid 55 therein independently of the sealed container 2 is connected to the sealed container 2 through a cooling liquid conduit 59. The cooling liquid sealing tank 58 has an upper space 60 above the level of the cooling liquid 55 stored therein. The air conduit 36 branched from the air pressurizing conduit is connected through the vibrator pressurization control valve 37 to the cooling liquid sealing tank 58.

In operation, air is introduced under pressure from the air compressor 18 into the upper space 16 in the cleaning solution sealing tank 14 and the upper space 60 in the cooling liquid sealing tank 58. Therefore, the cleaning solution 3 in the cleaning solution sealing tank 14 is pressurized, and the pressure is transmitted through the liquid conduit 15 to the cleaning solution 3 in the ultrasonic cleaning tank 1. Simultaneously, the cooling liquid 55 in the cooling liquid sealing tank 58 is pressurized, and the pressure is transmitted through the cooling liquid conduit 59 to the cooling liquid 55 in the sealed container 2. Thus, the pressure of the cooling liquid 55 in the sealed container 2 is maintained at substantially the same level as the pressure of the cleaning solution 3 in the ultrasonic cleaning tank 1.

The cooling liquid 55 should preferably comprise a refrigerant having a high heat-exchanging capability, and not erode the sealed container 2 and the ultrasonic vibrator and also not cause a dielectric breakdown of the ultrasonic vibrator. Preferably, the cooling liquid 55 may be an inert fluorine liquid composed of highly fluorinated hydrocarbon, e.g., Fluorinert (trademark) manufactured by Sumitomo 3M Co., Ltd.

In each of the above embodiments, the liquid conduit 15 is connected to the cleaning solution supply conduit 8. However, the liquid conduit 15 may be connected directly to the ultrasonic cleaning tank 1. The cleaning process in the pressurized ultrasonic cleaning apparatus according to the above embodiments may be automatically carried out by a controller which controls the operation of the tank body 4, the lid 6, and the various valves.

Although certain preferred embodiments of the present invention has been shown and described in detail, it should be understood that various changes and modifications may be made therein without departing from the scope of the appended claims.

What is claimed is:

1. A pressurized ultrasonic cleaning apparatus comprising:

an ultrasonic cleaning tank having a tank body for accommodating a cleaning solution therein, an ultrasonic vibrator housed in a sealed container mounted on a bottom wall of said thank body, and an openable lid for sealingly closing said tank body when a workpiece to be cleaned is immersed in the cleaning solution in the tank body;

cleaning solution supply means for supplying the cleaning solution to fill up an entire space in said ultrasonic cleaning tank when said tank body is closed by said lid;

pressurizing means for applying a positive pressure to the cleaning solution which fills said ultrasonic cleaning tank and for applying a positive pressure to an interior space of said sealed container;

a liquid sealing tank for accommodating a liquid to be introduced under pressure into said sealed container; and a liquid pressurizing conduit interconnecting said sealed container and said liquid sealing tank;

said pressurizing means comprising:

a cleaning solution sealing tank provided separate from said ultrasonic cleaning tank for accommodating a portion of the cleaning solution therein independently of said ultrasonic cleaning tank;

a liquid conduit interconnecting said ultrasonic cleaning tank and said cleaning solution sealing tank; and a pressurizing device for applying a positive pressure to the portion of the cleaning solution in said cleaning solution sealing tank, thereby transmitting the pressure applied to the portion of the cleaning solution in said sealing tank through said liquid conduit to the cleaning solution in said ultrasonic cleaning tank, said pressurizing device also applying a positive pressure to the liquid in said liquid sealing tank to transmit the pressure applied to said liquid through said liquid pressurizing conduit to said sealed container.

2. A pressurized ultrasonic cleaning apparatus according to claim 1, wherein said pressurizing device comprises a gas pressurizing device for pressurizing the cleaning solution in said cleaning solution sealing tank through a gas under pressure.

3. A pressurized ultrasonic cleaning apparatus according to claim 1, further comprising cleaning solution circulating means for circulating the cleaning solution accommodated in said ultrasonic cleaning tank, said pressurizing means comprising means for transmitting the pressure to said ultrasonic cleaning tank through said cleaning solution circulating means.

4. A pressurized ultrasonic cleaning apparatus according to claim 1, wherein said pressurizing device comprises a gas pressurizing device for applying a positive pressure to the cleaning solution in said cleaning solution sealing tank through a gas under pressure, and said gas pressurizing device also applying a positive pressure to the liquid in said liquid sealing tank through the gas under pressure to transmit the pressure applied to said liquid through said liquid pressurizing conduit to said sealed container.

* * * * *